US006536166B1

(12) United States Patent
Alley

(10) Patent No.: US 6,536,166 B1
(45) **Date of Patent: *Mar. 25, 2003**

(54) SNOW GUARD MOUNTING ASSEMBLY WITH DEFORMABLE CLAMPING MEMBER

(76) Inventor: F. William Alley, Gebbie Rd., Greensboro, VT (US) 05841

( * ) Notice: Subject to any disclaimer, the term of this patent is extended or adjusted under 35 U.S.C. 154(b) by 0 days.

This patent is subject to a terminal disclaimer.

(21) Appl. No.: 09/933,221

(22) Filed: Aug. 20, 2001

(51) Int. Cl.[7] ..... E04D 13/00
(52) U.S. Cl. ..... 52/25; 52/24; 52/26; 411/432
(58) Field of Search ..... 52/25

(56) References Cited

U.S. PATENT DOCUMENTS

| | | | | | |
|---|---|---|---|---|---|
| 42,992 | A | | 5/1864 | Howe | |
| 5,228,248 | A | * | 7/1993 | Haddock | 52/25 |
| 5,613,328 | A | * | 3/1997 | Alley | 52/25 |
| 5,732,513 | A | * | 3/1998 | Alley | 411/432 |
| 6,256,934 | B1 | * | 7/2001 | Alley | 52/24 |
| 6,318,028 | B2 | * | 11/2001 | Alley | 411/432 |

OTHER PUBLICATIONS

U.S. patent application Ser. No. 09/397,938, Alley, filed Sep. 17, 1999.
U.S. patent application Ser. No. 09/952,179, Alley, filed Sep. 11, 2001.

* cited by examiner

*Primary Examiner*—Carl D. Friedman
*Assistant Examiner*—Basil Katcheves
(74) *Attorney, Agent, or Firm*—Burr & Brown

(57) ABSTRACT

A snow guard assembly adapted to be attached to a metal roof seam by a mounting assembly is provided. The mounting assembly includes a mounting block having a seam-receiving groove formed in a bottom surface thereof, and at least one coupling means extending through a first side portion of the mounting block and having a terminal end adapted to move toward a central axis of the seam-receiving groove. At least one clamping member is interposed between the central axis of the seam-receiving groove and the coupling means, having a first side opposing the terminal end of the coupling means and a second side adapted to oppose a metal roof seam. The clamping member is preferably a plastically deformable metal material having a sufficiently small thickness such that, upon engagement with the terminal end of the coupling means, a protrusion is formed on the second side of the clamping member.

32 Claims, 6 Drawing Sheets

SNOW GUARD MOUNTING ASSEMBLY WITH DEFORMABLE CLAMPING MEMBER

BACKGROUND OF THE INVENTION

The present invention relates generally to a roof-mounted snow guard assembly to retain accumulated snow and prevent damage and injury caused by snow sliding off the roof surface, and more particularly, to an improved mounting block for securing such snow guard assemblies to a metal roof seam.

Snow guard assemblies have long been used for inhibiting and directing the movement of snow and ice across selected or pitched areas of roofs, as a preventive measure to mitigate the damage caused by migrating and falling snow and ice accumulations. An early application of snow guard assemblies is taught in U.S. Pat. No. 42,972 to Howe, which issued May 31, 1864. Recently, snow guard assemblies have increased in popularity, and currently several snow guard mounting assemblies serve to hold snowloads on roofs. Relevant examples include U.S. Pat. Nos. 5,613,328, and 5,732,513, each to Alley, each of which is herein incorporated in its entirety by reference.

Changing weather conditions, such as high winds or cyclically varying temperatures, create an environment which can induce physical changes in the accumulated snow, and give rise to the conditions tending to cause a snowpack to slide off of a sloped roof. Dislocated snow and ice often cause damage to surrounding property and, in some cases, the sliding snow can cause serious bodily injury. The problem of sliding snow is particularly prevalent on metal roofs. Metal roofs offer many structural advantages, such as strength and durability. However, because metal tends to absorb environmental heat, even a minimal amount of panel expansion or contraction exacerbates the conditions leading to snow slides. Furthermore, metal roofs generally afford little surface friction, which is also conducive to snow slides.

The increasing popularity of construction incorporating metal roof materials also poses particular problems with respect to attaching snow guard assemblies. A typical metal roof comprises a plurality of juxtaposed metal panels typically having substantially perpendicular edges that abut to form a joint therebetween. The perpendicular edges of the abutting panels are each crimped together and/or bent downwardly over each other forming a sealed seam which both connects the roofing panels and prevents fluid communication between and beneath the roof panels.

In snow guard assemblies for seamed metal roofs, the mounting block assembly is typically secured to the roof seam using a coupling means, such as screws or bolts. These screws or bolts generally pass through a sidewall of the mounting block seated around the seam, and extend inwardly, to contact the roof seam. However, screws and bolts tend to puncture, abrade, or otherwise damage the surface coating of the metal roof seam seal when tightened to securely fasten the mounting assembly. Holes or fissures thusly created destroy the hermeticity of the metal roof, especially upon removal of the snow guard, and allow water to permeate the seam even while the snow guard is still attached. The water tends to attack the exposed metal beneath the damaged surface coating, creating rust or seeping rust stains, which weakens the metal and diminishes the intrinsic aesthetic qualities of metal roofs.

Prior attempts to address this problem include using a mounting block capable of being attached to a metal roof without tearing, puncturing or otherwise destroying the hermeticity of the metal roof seam, as described U.S. Pat. No. 5,613,328. In order to attach the mounting block to the seam, a ball and set-screw is provided, such that the curved surface of the ball, rather than the end of the screw, engages a portion of the roof seam. As the screw is tightened to attach the mounting block, the ball forms a pocket in the engaged portion of the seam such that the mounting block can be secured to the roof without piercing or tearing the seam.

Although this method of attachment is an improvement over the prior art attaching means, drawbacks remain. For example, the entire holding force per coupling means is limited to the contact area between the seam and each ball, which is only a singular, independent contact surface. Because such a design requires that the entire contact force be applied through a single contact surface on each ball, the total amount of static holding force (which is equal to the summation of the holding forces of each individual contact surface) is determined by the number of balls engaging the roof seam. Thus, the net holding force available for holding the mounting block in place is significantly limited, and sliding will occur if the force of the snow load exceeds the friction force at that singular point of contact.

Yet another drawback of the ball and set-screw assembly relates to the occasional rotation of the ball element in conjunction with the turning of the set-screw, instead of gripping to form a stationary contact surface with the metal seam. This unwanted turning may give rise to damage on the contact surface of the seam, and effectively undermine the benefits of employing a ball and set-screw coupling means.

Another drawback associated with prior art mounting block assemblies for snow guard assemblies relates to corrosion caused by the contact between the metal seam and the metal groove in the mounting block coupled with the exposure to high degrees of moisture typical of roofs. The corrosion is a result of a galvanic reaction between the metal roof, typically copper, and the metal groove in the mounting block, typically aluminum. This can lead to many harmful conditions, both cosmetic and structural, including unsightly deposits on the roof panels and a weakened coupling between the seam and snow guard assembly. Additionally, the corrosion and moisture infiltration eventually degrade the hermeticity of the metal roof.

Efforts to combat the corrosion caused by the galvanic reaction include fabricating the mounting block using a non-reactive metal, such as stainless steel. However, using stainless steel instead of aluminum significantly increases overall manufacturing and consumer costs, and does not address the problem of moisture communication and physical harm to the surface of the seam caused by fastening with screws or bolts. Another attempt to combat reactivity involves using a non-corrosive insert as an interface in the metal groove of the mounting block, between the mounting block and the roof seam, as described in Applicant's pending application Ser. No. 09/397,938, the entirety of which is incorporated herein by reference. However, such non-reactive inserts do not afford the seam protection from invasive coupling means, since the coupling means penetrate the inserts and directly contact the seam.

Thus, it would be desirable to provide a snow guard assembly having a means for securing a mounting block assembly onto a metal roof seam which addresses each of the primary problems associated with the prior art. That is, it would be desirable to provide a snow guard assembly having a means for securing a mounting block assembly onto a metal roof seam which prevents physical breach of the seam integrity by a coupling means and which preferably eliminates the negative effects of galvanic reactions between the roofing material and the mounting block, to better preserve the hermeticity of the roof. Further, a cost effective means of achieving the aforementioned goals is also desired.

SUMMARY OF THE INVENTION

It is an object of the present invention to overcome the drawbacks of the prior art, particularly to provide a cost effective snow guard assembly having a means for securing a mounting block assembly onto a metal roof seam which prevents physical breach of the seam integrity by a coupling means and which preferably eliminates the negative effects of galvanic reactions between the roofing material and the mounting block.

In accordance with one embodiment of the present invention, a snow guard assembly adapted to be attached to a metal roof seam by a mounting assembly is provided. The mounting assembly includes a mounting block having a seam-receiving groove formed in a bottom surface thereof, and at least one coupling means extending through a first side portion of the mounting block and having a terminal end adapted to move toward a central axis of the seam-receiving groove. The assembly further includes at least one clamping member, interposed between the central axis of the seam-receiving groove and the coupling means, having a first side opposing the terminal end of the coupling means and a second side adapted to oppose a metal roof seam. The clamping member is preferably a plastically deformable metal material having a thickness that is sufficiently small such that, upon engagement of the terminal end of the coupling means on the first side of the clamping member, a protrusion is formed on the second side of the clamping member at a location opposed to the terminal end of the coupling means.

Preferably, the clamping member is an integral part of the mounting block, the seam-receiving groove is defined partially by an internal upper surface of the mounting block, and the clamping member extends downwardly from the internal upper surface. It is also preferable that the terminal end of the coupling means passes through a first internal side surface of the mounting block and a second internal side surface of the mounting block includes one of a recess and a protrusion at a location opposed to the terminal end of the coupling means. It is also preferred to include at least two of the coupling means extending through the first side portion of the mounting block, each coupling means being adapted to engage different portions of the clamping member. Further, the seam-receiving groove preferably extends along the entire length of the mounting block and the clamping member extends along the entire length of the seam-receiving groove.

According to a second embodiment of the present invention, the snow guard assembly includes a mounting assembly having a mounting block having a seam-receiving groove formed in a bottom surface thereof, defined partially by an internal upper surface of the mounting block. The mounting block also includes first and second coupling means extending through opposed first and second side portions of the mounting block, respectively. Each coupling means includes a terminal end adapted to move toward a central axis of the seam-receiving groove. The mounting assembly further includes first and second clamping members formed integrally with the mounting block, extending downwardly from the internal upper surface, and interposed between the central axis of the seam-receiving groove and the first and second coupling means respectively. Each clamping member includes a first side opposing the terminal end of a respective one of the coupling means and a second side adapted to oppose a metal roof seam. Each clamping member is made of a plastically deformable metal material having a thickness that is sufficiently small such that, upon engagement of the terminal end of a respective one of the coupling means on the first side of the clamping member, a protrusion is formed on the second side of the clamping member at a location opposed to the terminal end of the respective one of the coupling means. The seam-receiving groove of the second embodiment preferably extends along the entire length of the mounting block, and the first and second clamping members extend along the entire length of the seam-receiving groove in a spaced parallel relationship with one another on opposing sides of the central axis of the seam-receiving groove. The first and second coupling means are preferably axially offset from one another along the length of the mounting block.

In a preferred modification of the second embodiment, the second side of each of the first and second clamping members preferably includes a corrosion-resistant, non-metallic coating. More preferably, the corrosion-resistant, non-metallic coating also covers that portion of the internal upper surface of the mounting block that is positioned between the first and second clamping members.

According to a third embodiment of the present invention, the snow guard assembly includes a mounting assembly having a mounting block having a seam-receiving groove formed in a bottom surface thereof, defined partially by an internal upper surface of the mounting block. The mounting assembly also includes first and second coupling means extending through opposed first and second side portions of the mounting block, respectively, wherein each coupling means includes a terminal end adapted to move toward a central axis of the seam-receiving groove. The mounting assembly further includes a clamping member having first and second sidewalls spaced apart from one another. The clamping member is freely positioned within the seam-receiving groove such that the first and second sidewalls are positioned between the central axis of the seam-receiving groove and the first and second coupling means, respectively. Each of the sidewalls includes a first side opposing the terminal end of a respective one of the coupling means and a second side adapted to oppose a metal roof seam.

The sidewalls of the clamping member are preferably made of a plastically deformable metal material having a thickness that is sufficiently small such that, upon engagement of the terminal end of a respective one of the coupling means on the first side of the sidewall, a protrusion is formed on the second side of the sidewall at a location opposed to the terminal end of the respective one of the coupling means.

The preferred clamping member of the third embodiment also includes a top wall connecting the first and second sidewalls to one another. More preferably, the clamping member is configured in the shape of an inverted U, including a non-metallic coating on the second side of each sidewall of the clamping member. It is further preferred that the corrosion-resistant, non-metallic coating also covers an internal surface of the top wall of the clamping member. It is also preferred that the mounting assembly includes two clamping members spaced apart from one another along the length of the mounting block, wherein the first and second coupling means engage a first one of the clamping members, and the first and second coupling means are axially offset from one another along the length of the mounting block. Third and fourth coupling means, extending through the opposed first and second side portions of the mounting block, respectively, can also be provided. Each of the third and fourth coupling means includes a terminal end that engages the other one of the clamping members. The third and fourth coupling means are also axially offset from one another along the length of the mounting block.

According to another embodiment of the present invention, a coupling element adaptable to connect a first and a second component is provided, including a substantially cylindrical first member adapted to contact a first component, and a second member adapted to contact the first member and a second component. The first member extends in a longitudinal direction from a first end thereof to an opposed second end thereof. The first member includes a bore portion extending in the longitudinal direction from an opening on the second end of the first member toward the first end of the first member, and having a circumference C. The second member includes a substantially cylindrical first portion having a first end, an opposed second end, and a circumference C1 being less than C. The second member further includes a second portion proximate the second end of the first portion, having a dimension extending in a direction substantially perpendicular to the longitudinal direction, and having a first surface from which the first portion extends in a longitudinal direction and an opposed second surface adapted to contact a second component.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DESCRIPTION OF THE INVENTION

Figure 1:
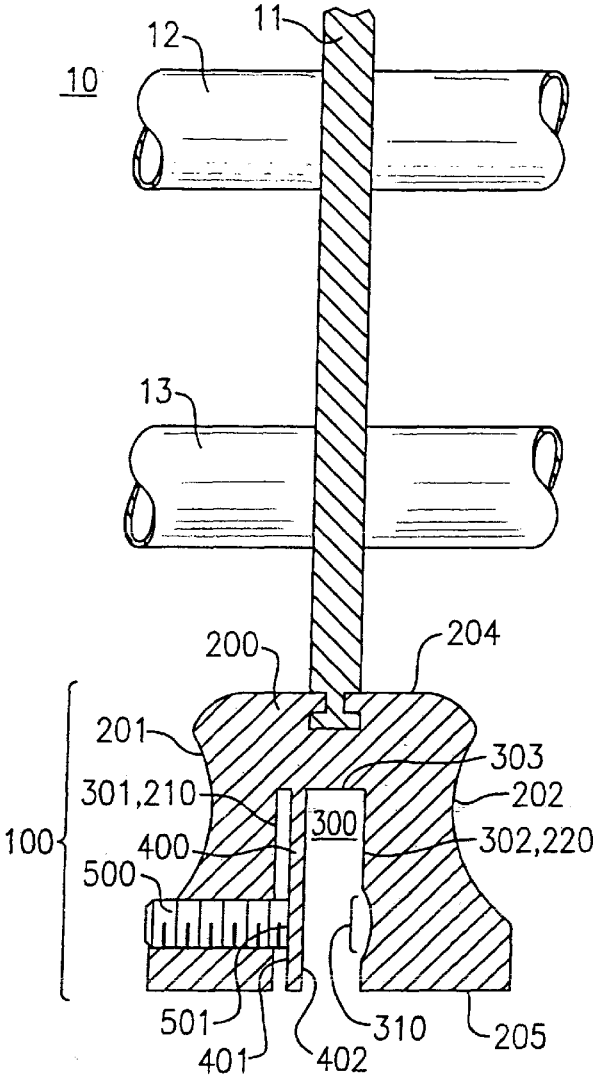
FIG. 1 is a cross-sectional front view of a snow guard assembly according to one embodiment of the present invention.

FIG. 1 is a cross-sectional view of a snow guard assembly 10 according to one embodiment of the present invention, including bracket 11, snow guard pipes 12 and 13, and mounting assembly 100. The mounting assembly 100 includes mounting block 200 having seam-receiving groove 300 formed on the bottom surface 205 thereof. The seam-receiving groove 300 is defined by a first side 301 proximate to the first side portion 201 of mounting block 200. The seam-receiving groove 300 is further defined by a second side 302, proximate the second side portion 202 of mounting block 200, as well as an internal upper surface 303 proximate the top end 204 of mounting block 200.

The mounting block 200 also includes an integrated clamping member 400, extending downwardly from internal upper surface 303 toward bottom surface 205 within the seam-receiving groove 300. The clamping member 400 includes a first side 401 opposing the first side 301 of seam-receiving grove 300, and a second side 402 opposing the second side 302 of seam-receiving grove 300.

The mounting assembly further includes a coupling means 500 extending through the first side portion 201 of mounting block 200 into seam-receiving grove 300 at the first side 301 thereof, such that the terminal end 501 is proximate to and opposing the first side 401 of clamping member 400. A recess 310 is positioned on the second side 302 of seam-receiving groove 300 at a location opposite the terminal end 501 of coupling means 500.

Figure 2:
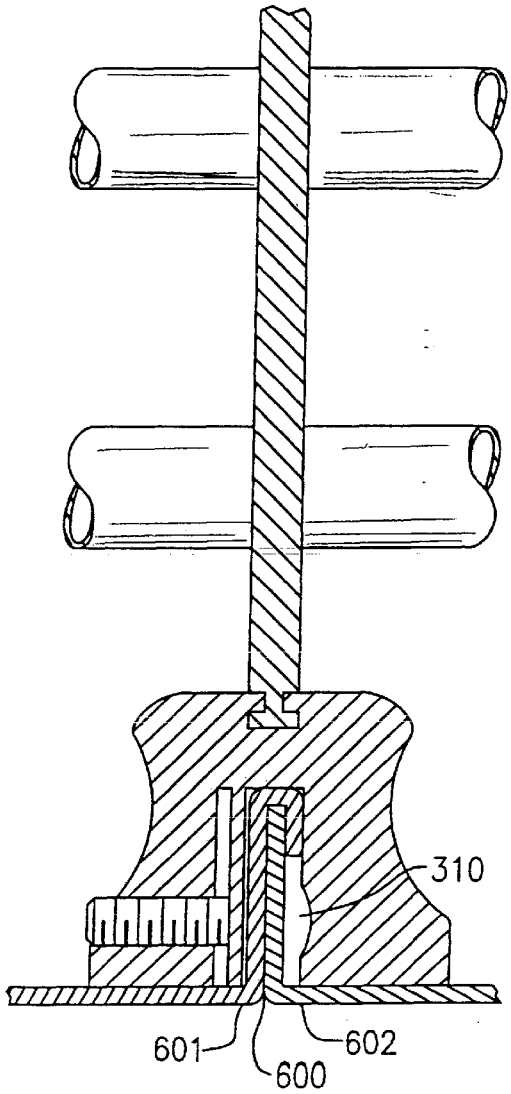
FIG. 2 is a cross-sectional front view of the snow guard assembly of FIG. 1, positioned on a metal roof seam, and before the coupling means is engaged to secure the mounting assembly.

FIG. 2 is a cross-sectional view of the snow guard assembly 10 of FIG. 1, positioned on a metal roof seam 600, before the coupling means 500 is engaged to secure the mounting assembly 100 thereto.

Figure 3:
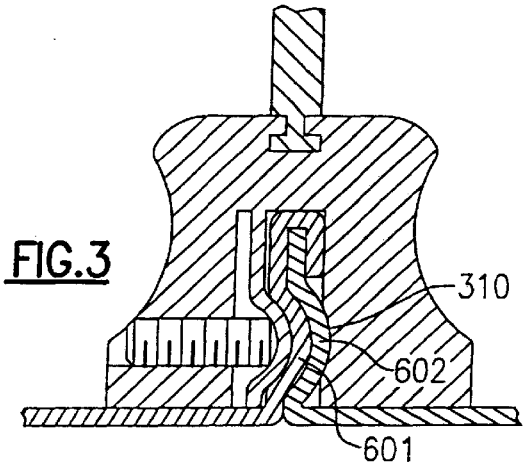
FIG. 3 is a cross-sectional front view of the mounting assembly of FIG. 1, as attached to a metal roof seam, and after the coupling means is engaged to secure the mounting block.

FIG. 3 is a cross-sectional front view of the mounting assembly 100 of FIG. 1 and FIG. 2, as attached to a metal roof seam 600, after the coupling means 500 is engaged to secure the mounting block 200 onto the seam. The mounting assembly 100 is positioned above the metal roof seam 600 such that the seam-receiving groove 300 receives the seam 600.

Upon the application of a torquing force, the terminal end 501 of coupling means 500 passes through the first side portion 201 of the mounting block 200 inwardly, to the first side 301 of the seam-receiving groove 300, and toward the central axis thereof. The terminal end 501 contacts and plastically deforms the first side 410 of clamping member 400, causing a protrusion on the second side 402 thereof. The protruding second side 402 contacts the first side 601 of metal roof seam 600, and under continued force from the terminal end 501 of the coupling means 500, causes a protrusion on the second side 602 thereof. The protrusion on the second side 602 presses into a pocket-like recess 310 on the second side 302 of seam-receiving groove 300.

According to this embodiment, the terminal end 501 of the coupling means 500 engages the first side 401 of the clamping means 400 without physical interaction with the metal roof seam, thus avoiding any damaging contact with the metal roof seam 600 itself. The gripping effect is achieved by the successive protrusions crimping upon one another under the application of force through the coupling means, and secures the mounting assembly 100 onto the metal roof seam 600 without compromising the surface integrity thereof. Further, the point contact problem associated with coupling means, such as a ball and set-screw assembly, or a substantially convex screw or bolt, is not present herein. That is, the pressure distribution area upon the plastically deformable clamping member from the substantially non-spherical terminal end of the coupling means is wider and greater, which facilitates the distribution of pressure over a wider area of the metal roof seam from the deformed clamping member, and thereby gripping the metal roof seam within the seam-receiving groove over a wider area.

Although a coupling means having a substantially flat terminal end 501 is shown, an alternate coupling means, such as a standard set-screw or bolt, can be used in conjunction with the present invention. Similarly, a set-screw and element assembly, such as a ball and set-screw, can be used as a coupling means.

Figure 4:
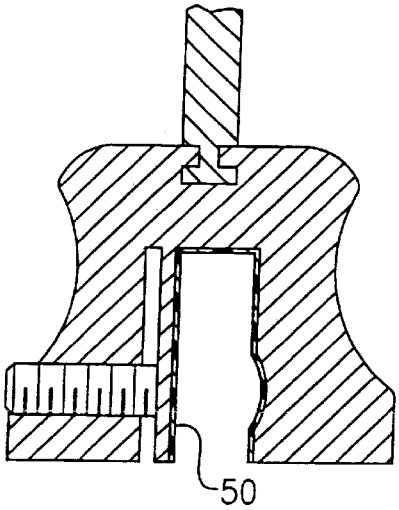
FIG. 4 is a cross-sectional front view of a preferred embodiment of the present invention as shown in FIG. 1.

FIG. 4 is a cross-sectional front view of a preferred embodiment of the present invention as shown in FIG. 1. Seam-receiving groove 300 includes a corrosion-resistant, non-metallic coating 50. The coating 50 covers the actual seam-receiving area, defined by the second side 402 of the clamping member 400, and the internal upper surface 302 and second side 302 of receiving groove 300. Because the coating 50 is a corrosion-resistant and non-metallic material, the metal to metal contact (as shown in FIG. 3) between the protruding second side 402 of clamping member 400 and seam 600 is eliminated. The desirable characteristics of the coating inhibit galvanic reactions between the metal clamping member, typically aluminum, and the metal roof seam, typically copper, which reactions are known to degrade the hermeticity of the roof. Examples of suitable coating materials include, but are not limited to, urethane, epoxy, plastic and aluminum oxide.

Figure 5:
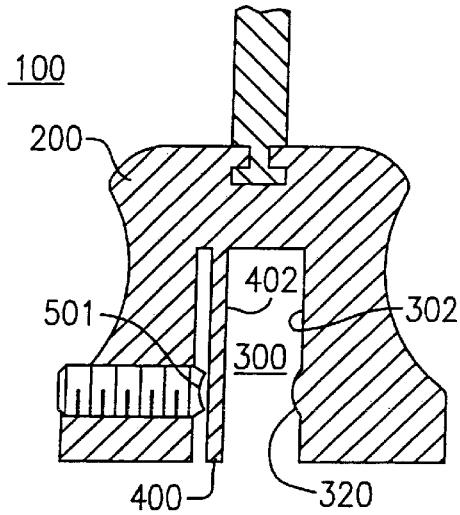
FIG. 5 is a cross-sectional front view of a mounting assembly according to another embodiment of the present invention.

The mounting assembly 100, as shown in FIG. 5, represents yet another embodiment of the present invention. The terminal end 501 of the coupling means 500 is concave, rather than substantially flat as shown in the preceding embodiments. Accordingly, a convex protrusion 320, rather than a recess 310, is located on the second side 302 of seam-receiving groove 300, opposite the concave terminal end 501.

When positioned on the metal roof seam 600 (not shown in this figure), and upon the application of force as described above, the terminal end 501 of the coupling means 500 engages the first side 401 of clamping member 400, causing a convex deformation thereof, and a corresponding concavity is formed on the second side 402 thereof. The gripping effect is similar to that of the prior embodiments in that the deformed clamping member 400 causes the metal roof seam 600 to likewise deform, and pinching contact between the deformed seam 600 and the protrusion 320 of the second side 302 of seam-receiving groove 300 holds the mounting block in place, preventing relative movement between the mounting block and the metal roof seam.

Figure 6:
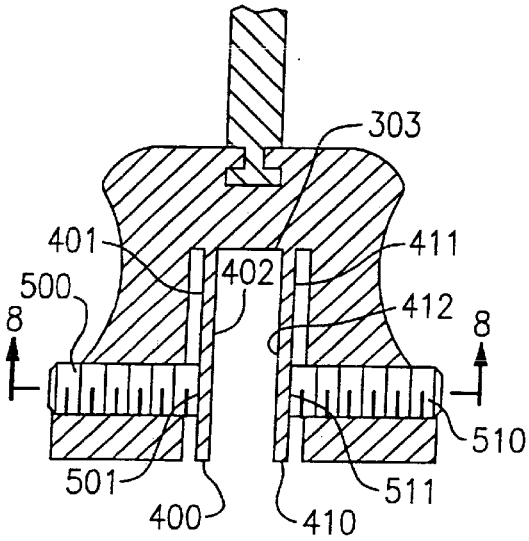
FIG. 6 is a cross-sectional front view of a mounting assembly according to yet another embodiment of the present invention.

FIG. 6 is a cross-sectional view of a mounting assembly according to yet another embodiment of the present invention. The mounting block 200 includes two clamping members integrally formed therewith, each extending downwardly from the internal upper surface 303 of the seam-receiving groove 300, positioned on opposite sides of the central axis thereof. A first clamping member 400 is positioned proximate the first side 201, and a second clamping member 410 is proximate the second side 202 of mounting block 200. The first clamping member 400 includes a first side 401 opposite the first side 301 of seam-receiving groove 300, and a second side 402 facing and opposing the second side 412 of the second clamping member 410. The second clamping member 410 includes a first side 411 opposite the second side 302 of seam-receiving groove 300, and a second side 412 facing and opposing the second side 402 of the second clamping member 400. That is, when accepted into the seam-receiving groove, the metal roof seam is flanked by the two clamping members, creating points of intimacy between the second sides of each clamping member and the inserted seam.

The embodiment of FIG. 6 further includes opposing coupling means, a first coupling means 500, and a second coupling means 510, positioned on either side of the central axis of the seam-receiving groove 300, such that the two clamping members are interposed therebetween. Each coupling means includes a terminal end 501 and 511 respectively, opposing the first side 401 and 411 of the respective clamping members 400 and 410.

Figure 7:
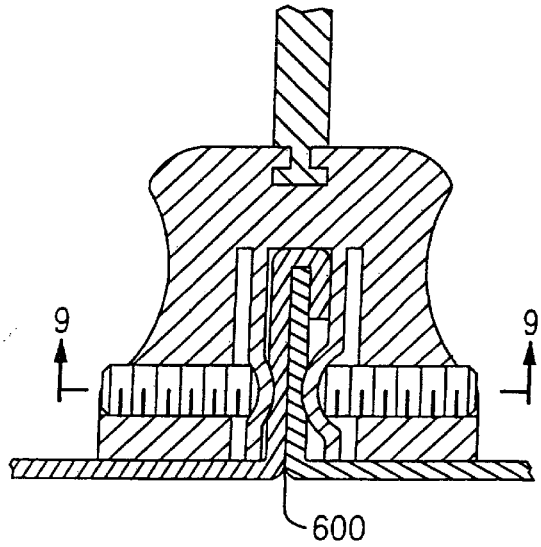
FIG. 7 is a cross-sectional front view of the mounting assembly of FIG. 6, shown as attached to a metal roof seam, and after the coupling means are engaged to secure the mounting block.

FIG. 7 is a cross-sectional view of the mounting assembly 100 of FIG. 6, shown as positioned on a metal roof seam 600 after the dual coupling means 500 and 510 are engaged to secure the mounting block 200. Pressure from the terminal ends 501 and 511 of the respective coupling, applied upon the first sides 401 and 411 of the clamping members, causes each clamping member to distort such that a protrusion is formed on the respective second sides 402 and 412 thereof. The metal roof seam 600, essentially sandwiched between the clamping members, is tightly clenched into an hour glass-like shape by the protruding second sides 402 and 412 thereof, and the mounting assembly is thusly secured. In this manner, the mounting assembly can be firmly fastened on each side without causing detrimental contact between the coupling means and the seam itself.

Figure 8:
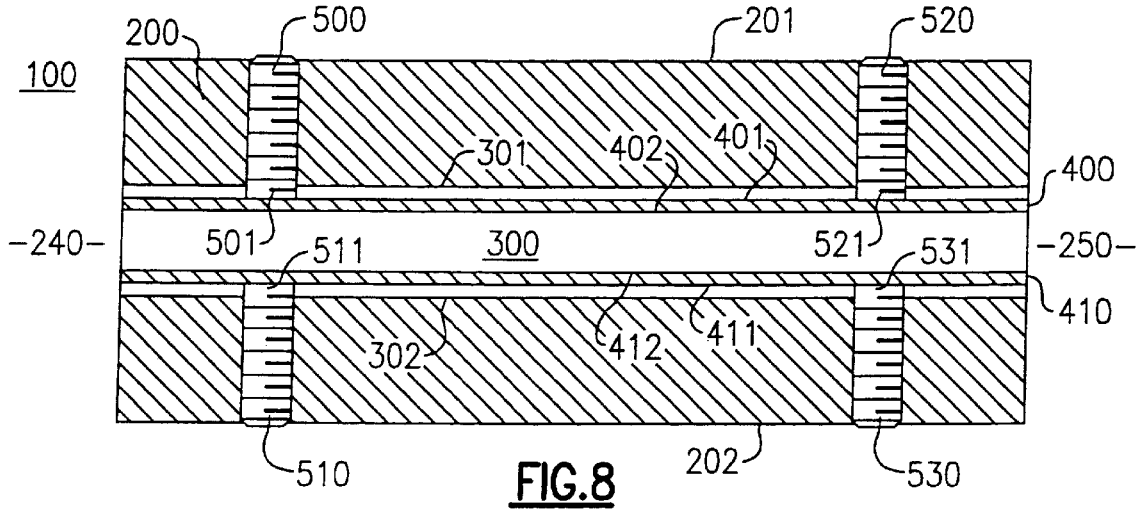
FIG. 8 is a cross-sectional view taken through line 8—8 in FIG. 6.

FIG. 8 is a cross-sectional view of the mounting assembly, taken through line 8—8 in FIG. 6, further including third and fourth coupling means 520 and 530 (not shown in FIG. 6). FIG. 6 shows the mounting assembly 100 in vertical cross-section as viewed from a front end 240 of the mounting block 200, whereas FIG. 8 shows the whole mounting block horizontally, from front end 240 to back end 250.

The seam-receiving groove 300 extends longitudinally along the mounting block 200 from front end 240 to back end 250. The clamping members 400 and 410 likewise longitudinally extend along the mounting block 200. A first pair of opposing coupling means 500 and 510 are proximate the front end 240 and positioned on opposite sides of the central axis of the seam-receiving groove 300. The first coupling means 500 extends through the first side 201 and the second coupling means 510 extends through the second side 202. A second pair of opposing coupling means 500 and 510 are proximate the back end 250, and positioned on opposite sides of the central axis of the seam-receiving groove 300. The third coupling means 520 extends through the first side 201 and the fourth coupling means 530 extends through the second side 202.

The terminal ends 501 and 521 of the first and third clamping members respectively oppose the first side 401 of the first clamping member 400 and come into contact therewith upon application of force. Similarly, terminal ends 511 and 531 of the second and fourth clamping members, respectively, oppose the first side 411 of the second clamping member 410 and come into contact therewith upon application of force.

Figure 9:
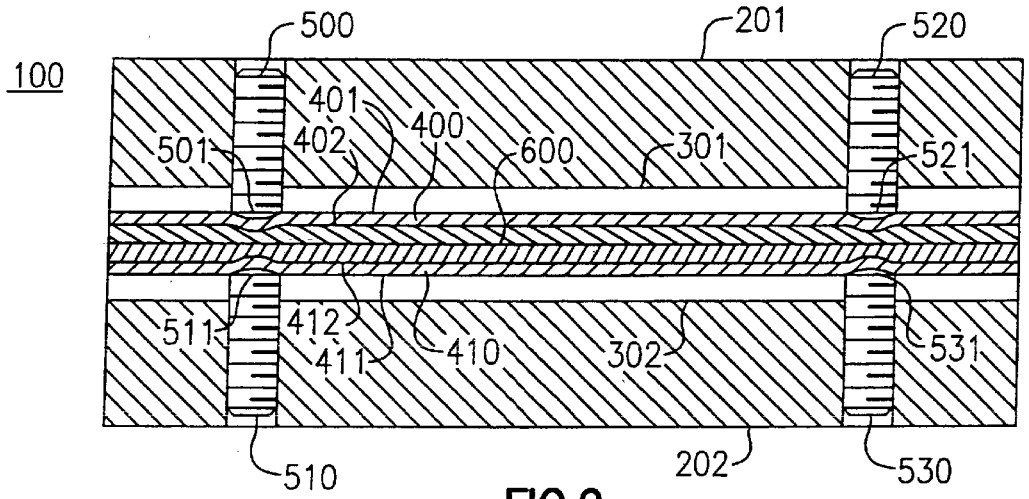
FIG. 9 is a cross-sectional view taken through line 9—9 in FIG. 7.

In conjunction with FIG. 8, FIG. 9 depicts the secured mounting assembly 100 on the metal roof seam 600 in cross-section taken through line 9—9 in FIG. 7. The force applied by the four coupling means causes the two clamping members to deform outwardly at the points of contact on the first sides thereof, forming protrusions on the second sides thereof, which pinch the metal roof seam 600 sandwiched therebetween within the seam-receiving groove 300. Again, the mounting assembly 100 is firmly attached without unwanted harmful contact between the coupling means and the seam.

Figure 10:
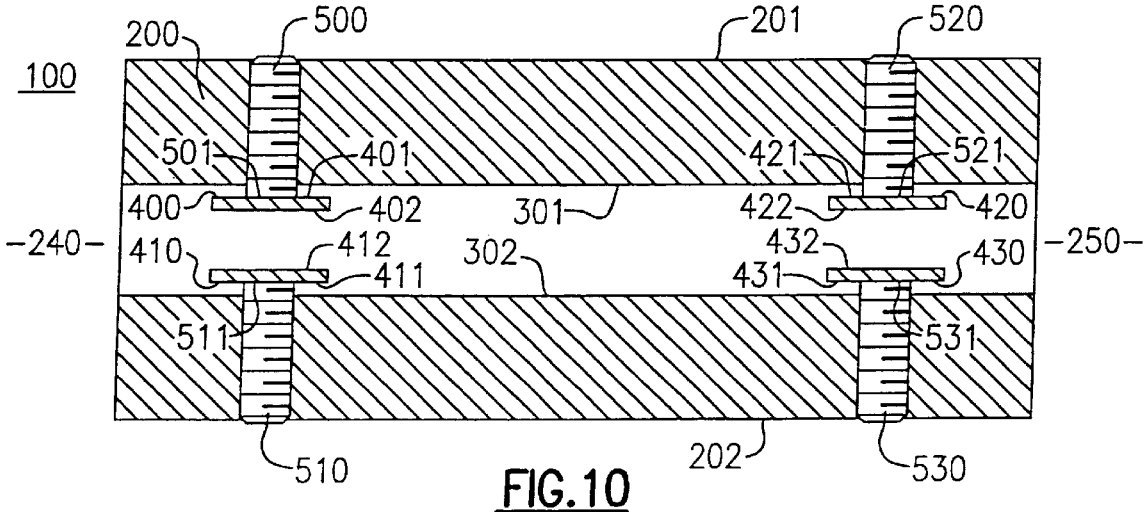
FIG. 10 is a horizontal cross-sectional top view of the mounting assembly shown in FIG. 8.

FIG. 10 is a cross-sectional view of the mounting assembly according to yet another embodiment of the present invention. The mounting block includes a seam-receiving groove 300 housing four clamping members, formed integrally with mounting block 200, and extending downwardly from the internal upper surface 303 of seam-receiving groove 300. A first opposing pair, 400 and 410, is positioned proximate the front end 240 and a second opposing pair, 420 and 430, is positioned proximate the back end 250. In this case, the clamping members are relatively isolated from one another, spaced at a distance within the same plane and on opposing sides of the central axis of the seam-receiving groove. That is, each clamping member does not extend longitudinally along the entire seam-receiving groove as previously shown.

The localized position of each clamping member can be achieved in a variety of ways. One method of isolating the coplanar clamping members includes post-forming machining to remove coplanar sections of the parallel clamping members proximate each end and along a desired distance proximate the middle of the seam-receiving groove. Another method includes forming a mounting block having multiple integral clamping members, spaced apart along the length of the seam-receiving groove and on opposite sides of the central axis thereof. Typical forming methods which can be manipulated to incorporate forming integral yet non-contiguous clamping members include casting and extrusion. However, an alternative to machining or otherwise incorporating multiple integrated clamping members is discussed in conjunction with FIGS. 11–15 below.

Figure 11:
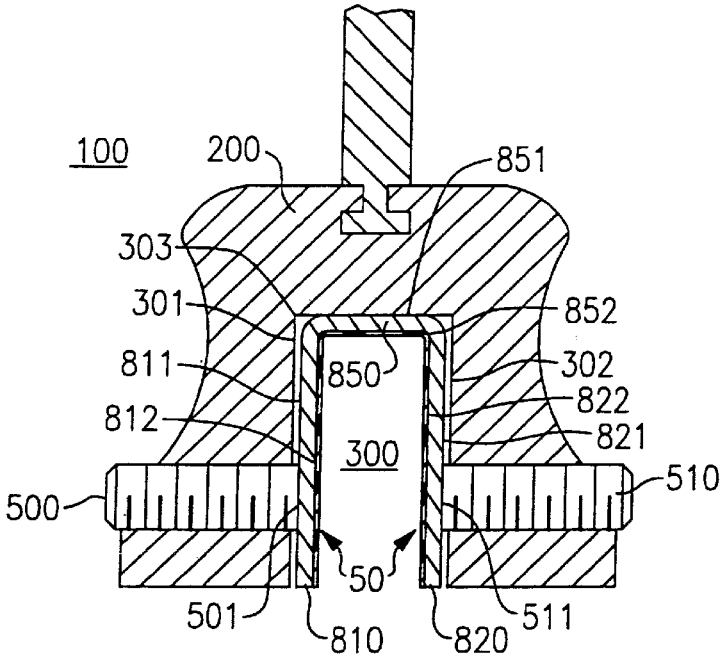
FIG. 11 is a cross-sectional front view of a mounting assembly according to yet another embodiment of the present invention.
Figure 12:
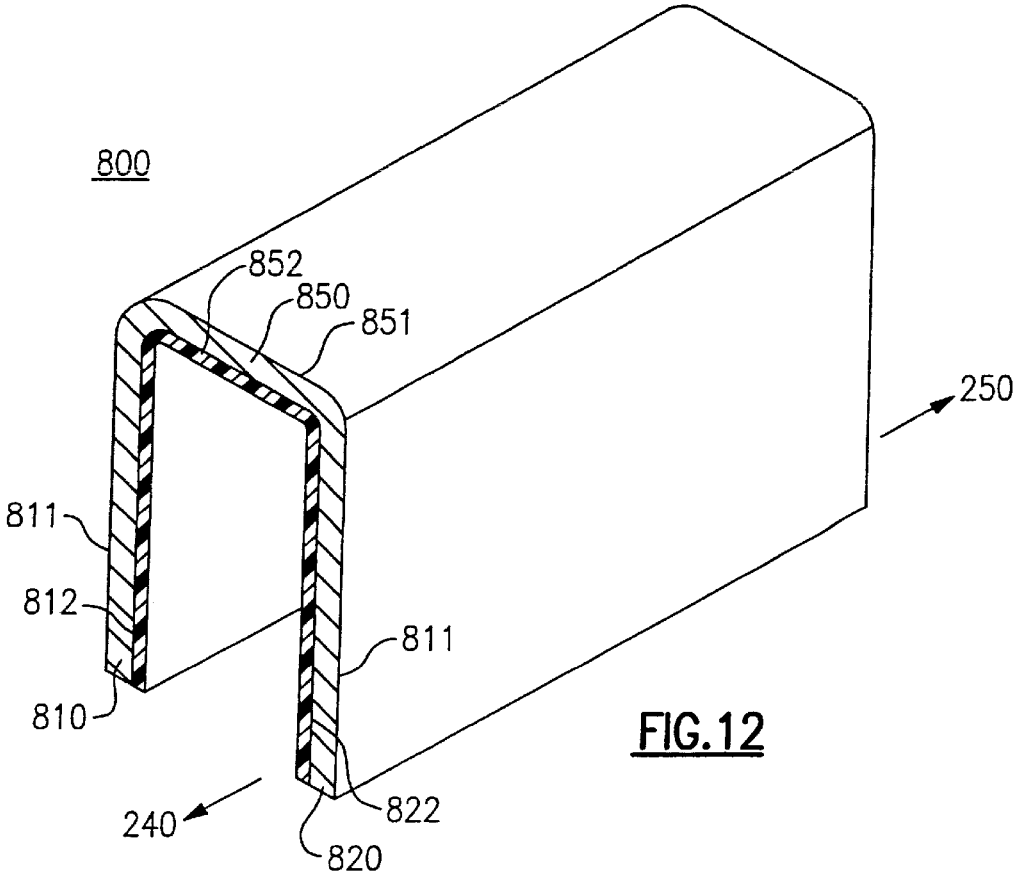
FIG. 12 is a perspective view of the inverted U-shaped clamping member unit shown in FIG. 11.

FIG. 11 is a cross-sectional front view of a mounting assembly 100 according to yet another embodiment of the present invention, viewed in conjunction with the perspective view of the inverted U-shaped clamping member unit 800 shown in FIG. 12. This embodiment includes dual opposing coupling means 500 and 510, extending inwardly toward the central axis of the seam-receiving groove 300 through the first and second sides 201 and 202 of the mounting block 200 respectively. The mounting block further includes a clamping member unit 800, which includes a top side 850, and opposing sidewalls 810 and 820, where the first sidewall 810 is proximate the first side 201, and the second sidewall 820 is proximate the second side 202 of the mounting block 200, on opposite sides of the central axis of the seam-receiving groove.

The first sidewall 810 includes a first side 811 opposite the terminal end 501 of the first coupling means 500, and a second side 812 opposing the second sidewall 820. The second sidewall 820 includes a first side 821 opposite the terminal end 511 of the second coupling means 510, and a second side 822 opposing the first sidewall 810. The top wall 850 connects the first and second sidewalls. The top wall 850 has a first side 851, which contacts the internal upper surface 302 of the seam-receiving groove 300, and a second side 852 that opposes a metal roof seam 600 upon receipt.

The clamping unit 800 preferably includes a non-corrosive, non-metallic coating 50 on the second side 812 of the first sidewall 810, the second side 822 of the second sidewall 820, and the second side 852 of the top side 850. In this manner, the seam-receiving area is substantially coated in the non-reactive material of coating 50, and no metal to metal contact occurs when the metal roof seam 600 is accepted into the thusly coated seam-receiving groove 300.

As described with respect to the prior examples, the coupling means contact and press upon the first sides of each clamping member, in this case each sidewall, forming a protrusion on the second sides thereof, which pinches the sandwiched seam and fastens the mounting assembly thereto. However, unlike the preceding embodiments, discrete clamping member units can be retrofitted at various positions within the seam-receiving groove of existing mounting blocks.

Figure 13:
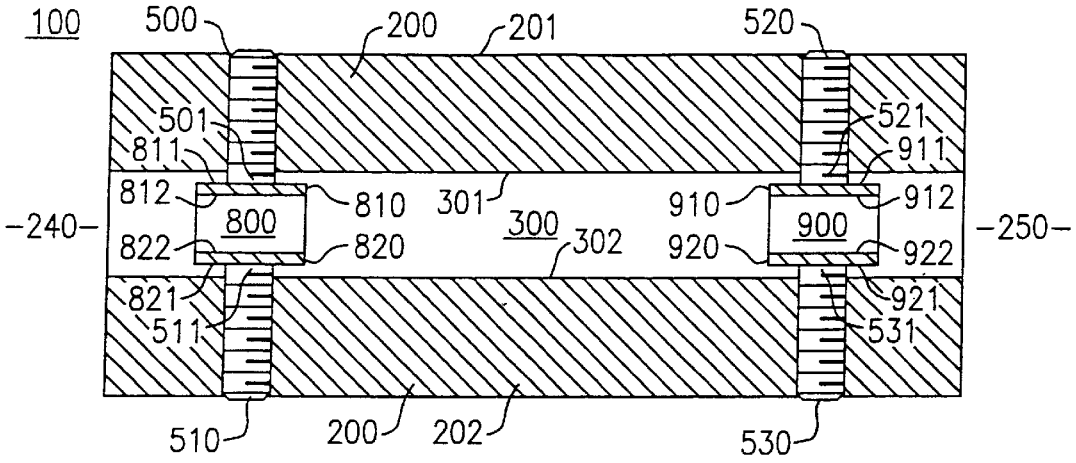
FIG. 13 is a horizontal cross-sectional top view of a mounting assembly according to yet another embodiment of the present invention.
Figure 14:
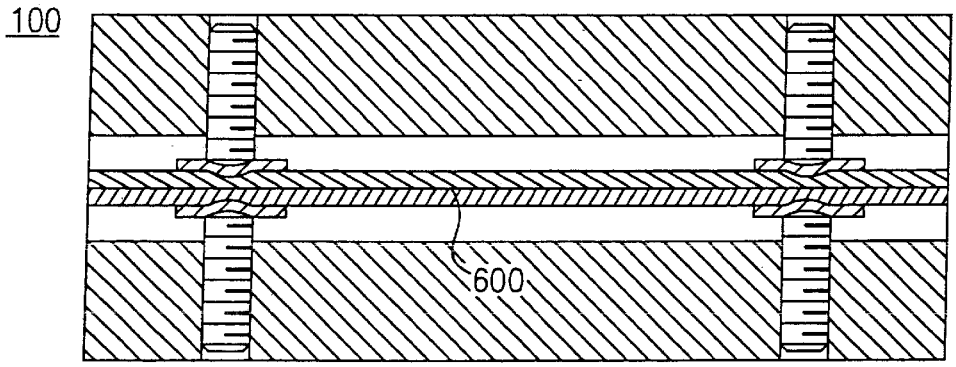
FIG. 14 is a cross-sectional view of the mounting assembly of FIG. 13, as attached to the metal roof seam, and after the coupling means are engaged to secure the mounting block.

FIG. 13, read in conjunction with FIG. 14, is a cross-sectional view of the mounting assembly 100 shown in FIG. 11, as attached to the metal roof seam 600, after the four coupling means (500, 510, 520, 530) contact the corresponding sidewalls (810, 820, 910, 920) of two clamping members units 800 and 900 to secure the mounting block 200.

The mounting block of this embodiment includes two discrete clamping member units 800 and 900, as described in FIG. 12. Each clamping member unit is positioned within the seam-receiving groove 300 such that the respective sidewalls 810. The top sides 850 and 950 each include a first side 851 and 951 which contacts the internal upper surface 302 of the seam-receiving groove 300 (not shown). The clamping member units are further positioned such that the first unit 800 is proximate the front end 240 of mounting block 200, and the second unit 900 is proximate the back end 250 of mounting block 200.

The clamping member units are also positioned such that the first side of each sidewall opposes coupling means 500, 510, 520 and 530. In this manner, an accepted metal roof seam 600 is crimped into an hourglass-like shape at two locations within the seam-receiving groove to secure the mounting assembly thereto. Contact between the coupling means and the metal seam does not occur, and unwanted interactions between the coupling means and the seam surface are avoided.

Figure 15:
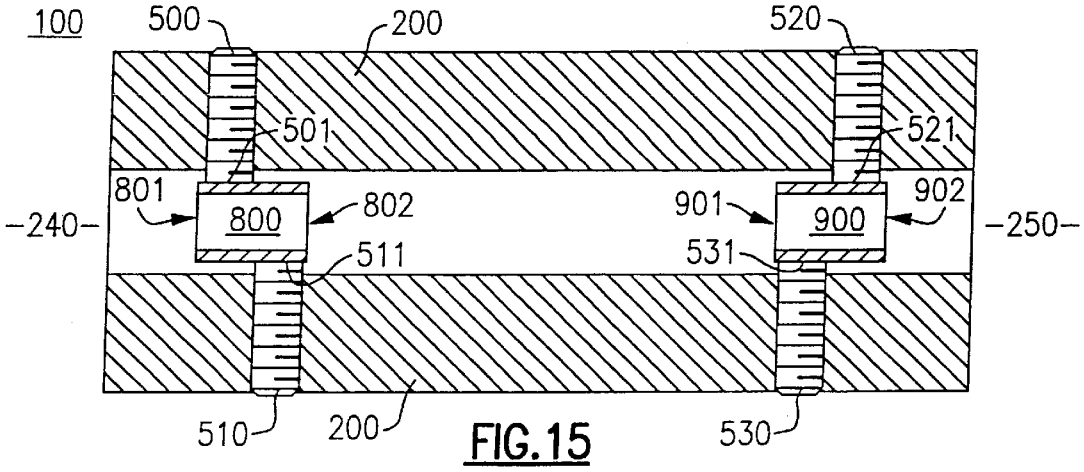
FIG. 15 is a cross-sectional view of a mounting assembly according to yet another embodiment of the present invention.

FIG. 15 is a cross-sectional view of a mounting assembly according to yet another embodiment of the present invention, which differs from the embodiment in FIG. 13 in that the coupling means are axially offset, rather than positioned directly across, from one another on opposite the central axis of the seam-receiving groove. The offset positioning of the coupling means creates points of contact at the terminal ends thereof with the respective first sides of each sidewall, which contact points are correspondingly offset from the center point of each clamping member. In this way, the force from the coupling means is concentrated toward alternating front and the back ends of the first and second clamping member units. As shown, the point of contact between the terminal end 501 of the first coupling means 500 and the first sidewall 810 of the first clamping member unit 800 is shifted toward the front end 801 thereof, and the point of contact between the terminal end 511 of the second coupling means 510 and the second sidewall 820 of the first clamping member unit 800 is shifted toward the back end 802 thereof.

Likewise, the point of contact between the terminal end 521 of the third coupling means 520 and the first sidewall 910 of the second clamping member unit 900 is shifted toward the back end 902 thereof, and the point of contact between the terminal end 531 of the fourth coupling means 530 and the second sidewall 920 of the second clamping member unit 900 is shifted toward the front end 901 thereof.

Upon acceptance into the seam-receiving groove 300, the sandwiched metal roof seam (not shown) is clenched in an S-shaped grip between the sidewalls of each clamping member unit at each end of the mounting block as force is applied to the coupling means. Although FIG. 15 is illustrative of an embodiment incorporating offset coupling means and discrete clamping member units, the coupling means can be likewise offset in embodiments including integrally formed clamping members, such as the one described in FIG. 9, to achieve the same S-shaped gripping effect.

Figure 16A:
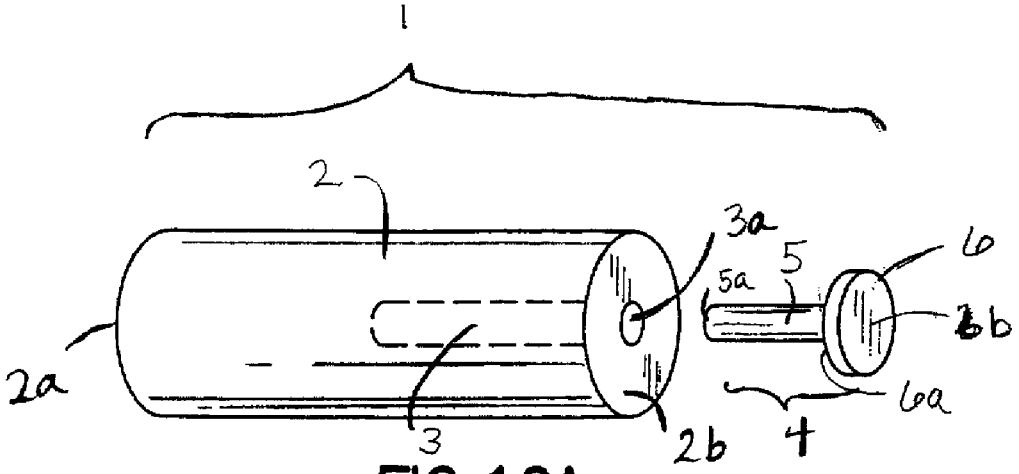
FIGS. 16A–B is a perspective view of a coupling means according to another embodiment of the present invention.

FIG. 16A is a perspective view of a coupling element 1 adaptable to connect a first and a second component (not shown). The substantially cylindrical first member 2 extends in a longitudinal direction from a first end 2*a* thereof to an opposed, substantially flat second end 2*b* thereof. The first member 2 includes a bore portion 3 extending in the longitudinal direction from an opening 3*a* on the second end 2*b* of first member 2 toward the first end 2*a* of first member 2, and having a circumference C. The second member 4 includes a substantially cylindrical first portion 5 having a first end 5*a,* an opposed second end 5*b,* and a circumference C1 being less than C. The second member further includes a second portion 6 proximate the second end 5*b* of the first portion 5, having a dimension extending in a direction substantially perpendicular to the longitudinal direction, and having a first surface 6*a* from which the first portion 5 extends in a longitudinal direction and an opposed second surface, terminal end 6*b,* adapted to contact a second component.

Figure 16B:
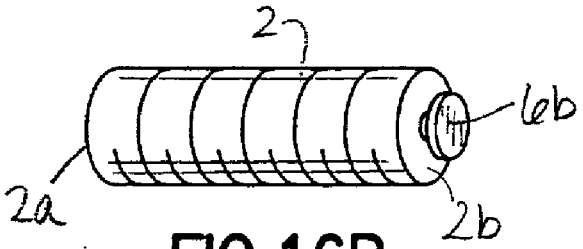

As shown in FIG. 16B, the first end 5*a* of the first portion 5 of the second member 4 is introduced into bore 3 of first member 2 through opening 3*a*. Preferably, circumference C1 of first portion 5 is sufficiently less than circumference C of bore 3 such that first portion 5 shares a loose fit relationship with bore 3. When used in connection with the snow guard assembly of present invention, coupling element 1 can be positioned as coupling element 500 shown in FIG. 1, such that the terminal end 6*b* is adapted to contact a clamping member or a metal roof seam, analogous to terminal end 501 of element 500.

Upon the application of force, typically a rotational torque, the first member 2 will tend to rotate, however, first portion 5 of second member 4 is not subjected to the same rotational force by virtue of the loose fit connection. That is, as first member 2 of coupling element 1 is rotationally driven in the second direction through a side of a mounting block, such as mounting block 200 of FIG. 1, the second member 4 moves inwardly therewith without itself experiencing substantial rotation. When sufficient force is applied, the terminal end 6*b* of second member 4 of coupling element 1 engages the first side of a clamping member interposed between coupling element 1 and a metal roof seam. The terminal end 6*b* essentially presses into the clamping member, creating a recess, or dimpled portion, on the first side thereof, and a corresponding protrusion on the second side thereof. The resulting sequential crimping grips the metal roof seam between the clamping member and the second side of the seam-receiving groove.

The pressing force exerted at terminal end 6*b* is preferred over a rotational force, especially in the case where coupling element 1 is included in a mounting assembly that does not use the clamping members of the present invention. In situations wherein the terminal end 6*b* would directly contact a metal roof seam, the pressing force therefrom sufficiently deforms the metal roof seam without causing surface damage that commonly results from a twisting force.

Figure 17A:
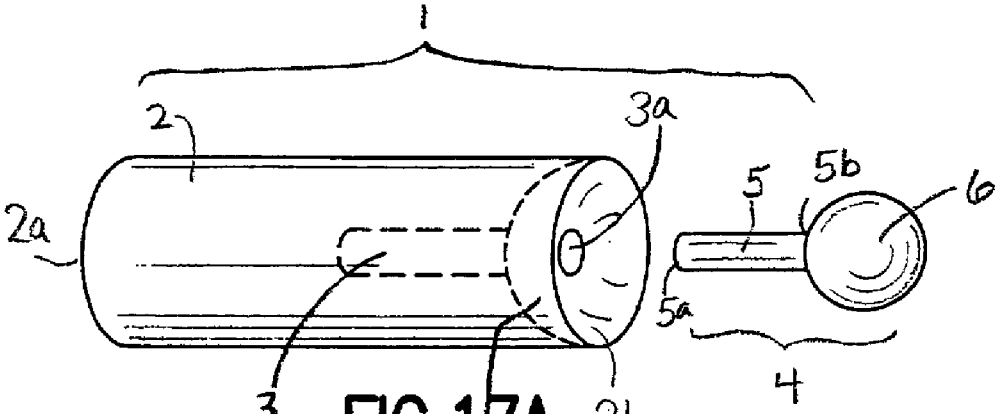
FIGS. 17A–B is a perspective view of a coupling means according to another embodiment of the present invention.

FIG. 17A is a perspective view of a coupling element 1 adaptable to connect a first and a second component (not shown). The substantially cylindrical first member 2 extends in a longitudinal direction from a first end 2*a* thereof to an opposed, substantially concave second end 2*b* thereof. The first member 2 includes a bore portion 3 extending in the longitudinal direction from an opening 3*a* on the second end 2*b* of first member 2 toward the first end 2*a* of first member 2, and having a circumference C. The second member 4 includes a substantially cylindrical first portion 5 having a first end 5*a*, an opposed second end 5*b*, and a circumference C1 being less than C. The second member further includes a substantially spherical second portion 6 proximate the second end 5*b* of the first portion 5, having a dimension extending in a direction substantially perpendicular to the longitudinal direction, and having a terminal contact surface 6*b,* adapted to contact a second component.

Figure 17B:
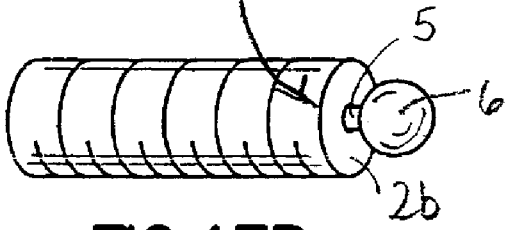

As shown in FIG. 17B, the first end 5*a* of the first portion 5 of the second member 4 is introduced into bore 3 of first member 2 through opening 3*a* on concave side 2*b*. Preferably, circumference C1 of first portion 5 is sufficiently less than circumference C of bore 3 such that first portion 5 shares a loose fit relationship with bore 3. When used in connection with the snow guard assembly of present invention, coupling element 1 can be positioned as coupling element 500 shown in FIG. 1, such that the terminal end 6*b* is adapted to contact a clamping member or a metal roof seam, analogous to terminal end 501 of element 500.

The coupling element 1 of FIGS. 17A–B functions in a similar manner to the coupling element 1 as shown in FIGS. 16A–B. That is, as first member 2 of coupling element 1 is rotationally driven in the second direction through a side of a mounting block, such as mounting block 200 of FIG. 1, second member 4 moves inwardly therewith without itself experiencing substantial rotation. The terminal end 6*b* of second member 4 of coupling element 1 engages the first side of a clamping member interposed between coupling element 1 and a metal roof seam. The terminal surface 6*b* essentially presses into the clamping member, creating a recess, or dimpled portion, on the first side thereof, and a corresponding protrusion on the second side thereof. The resulting sequential crimping grips the metal roof seam between the clamping member and the second side of the seam-receiving groove. Further, the coupling member 1 of FIGS. 17A–B can be used in connection with a snow guard assembly which does not incorporate the clamping members of the present invention for the same reasons as describe above in conjunction with FIGS. 16A–B.

Due to the loose-fit relationship between the first part 5 of the second member 4 of the coupling element 1 within the bore 3 of the first member 2, the second member 4 does not experience the rotational driving force felt by the first member 2. Rather, as the first member 2 is twisted inwardly through the appropriate side of the mounting block 200, the second member 4 remains relatively stationary until the second end 2*b* of the first member 2 contacts the second portion 6 of the second member 4. At that point, as the first member 2 continues to rotate inwardly and about the first portion 5 of the second member 4, the second portion 6 of the second member 4 is effectively pushed ahead, eventually exerting a pressing force on the clamping member, or the metal roof seam, upon contact therewith.

In addition to the pressing advantage, the coupling element described above can effectively function as a shear pin, providing the snow guard assembly with a beneficial break-away feature, wherein the second member of the coupling element is enabled to shear at a predetermined location under a force exceeding a predetermined threshold force to release the snow guard assembly from the metal roof seam. The break-away feature is desired to prevent portions of the metal roof itself from lifting and loosening under the weight and force from an excessive snow load on the snow guard attached thereto. The point of the shear and the threshold force can be controlled in a variety of ways. For example, adjusting the diameter of the first portion of the second member of the coupling element or using a score line at a predetermined location thereon will promote the shearing when the break-away feature is activated by an excessive snow load. Additionally, material selection is also an important consideration when engineering the coupling member as a shear pin, since some materials are known to shear under more or less force than others.

The structural relationship between the co-members of coupling element 1 also offers the handling convenience of a single unit, which is preferred over handling multiple, separate components like the prior art ball and set-screw components. Additionally, a light coating of a wax or a light cement can be applied to the first portion of the second member to help maintain the unity of the coupling element during shipping and installation. Its should be noted, however, that the coating merely provides a temporary joining of the first and second members of the coupling element for handling purposes, and is not sufficient to prevent relative rotation therebetween.

While the present invention has been particularly shown and described with reference to the preferred mode as illustrated in the drawings, it will be understood by one skilled in the art that various changes may be effected therein without departing from the spirit and the scope of the invention as defined by the claims.

We claim:

1. A snow guard assembly adapted to be attached to a metal roof seam by a mounting assembly, said mounting assembly comprising:

a mounting block having a seam-receiving groove formed in a bottom surface thereof;

at least one coupling means extending through a first side portion of said mounting block and having a terminal end adapted to move toward a central axis of said seam-receiving groove; and at least one clamping member interposed between the central axis of said seam-receiving groove and said coupling means, said clamping member having a first side opposing said terminal end of said coupling means and a second side adapted to oppose a metal roof seam, said clamping member comprising a plastically deformable metal material and having a thickness that is sufficiently small such that, upon engagement of said terminal end of said coupling means on said first side of said clamping member, a protrusion is formed on said second side of said clamping member at a location opposed to said terminal end of said coupling means.

2. The snow guard assembly of claim 1, wherein said clamping member is an integral part of said mounting block.

3. The snow guard assembly of claim 2, wherein said seam-receiving groove is defined partially by an internal upper surface of said mounting block, and said clamping member extends downwardly from said internal upper surface.

4. The snow guard assembly of claim 3, wherein said terminal end of said coupling means passes through a first internal side surface of said mounting block and a second internal side surface of said mounting block includes one of a recess and a protrusion at a location opposed to said terminal end of said coupling means.

5. The snow guard assembly of claim 1, further comprising a corrosion-resistant, non-metallic coating on said second side of said clamping member.

6. The snow guard assembly of claim 1, wherein said seam-receiving groove extends along the entire length of said mounting block and said clamping member extends along the entire length of said seam-receiving groove.

7. The snow guard assembly of claim 1, comprising at least two of said coupling means extending through said first side portion of said mounting block, each of said coupling means being adapted to engage different portions of said clamping member.

8. The snow guard assembly of claim 1, wherein said plastically deformable metal material is selected from the group consisting of stainless steel, anodized aluminum, aluminum alloys, copper and copper alloys.

9. A snow guard assembly adapted to be attached to a metal roof seam by a mounting assembly, said mounting assembly comprising:

a mounting block having a seam-receiving groove formed in a bottom surface thereof, said seam-receiving groove being defined partially by an internal upper surface of said mounting block;

first and second coupling means extending through opposed first and second side portions of said mounting block, respectively, each coupling means having a terminal end adapted to move toward a central axis of said seam-receiving groove;

first and second clamping members formed integrally with said mounting block and extending downwardly from said internal upper surface, said first and second clamping members being interposed between the central axis of said seam-receiving groove and said first and second coupling means, respectively, each clamping member having a first side opposing said terminal end of a respective one of said coupling means and a second side adapted to oppose a metal roof seam, each of said clamping members comprising a plastically deformable metal material and having a thickness that is sufficiently small such that, upon engagement of said terminal end of a respective one of said coupling means on said first side of said clamping member, a protrusion is formed on said second side of said clamping member at a location opposed to said terminal end of said respective one of said coupling means.

10. The snow guard assembly of claim 9, wherein said seam-receiving groove extends along the entire length of said mounting block and said first and second clamp members extend along the entire length of said seam-receiving groove in a spaced parallel relationship with one another.

11. The snow guard assembly of claim 9, wherein said first and second coupling means are axially offset from one another along the length of said mounting block.

12. The snow guard assembly of claim 11, further comprising third and fourth coupling means extending through said first and second side portions of said mounting block, respectively, said third and fourth coupling means being axially offset from one another along the length of said mounting block.

13. The snow guard assembly of claim 9, further comprising a corrosion-resistant, non-metallic coating on said second side of each of said first and second clamping members.

14. The snow guard assembly of claim 13, wherein said corrosion-resistant, non-metallic coating also covers that portion of said internal upper surface of said mounting block that is positioned between said first and second clamping members.

15. The snow guard assembly of claim 9, wherein said plastically deformable metal material is selected from the group consisting of stainless steel, anodized aluminum, aluminum alloys, copper and copper alloys.

16. A snow guard assembly adapted to be attached to a metal roof seam by a mounting assembly, said mounting assembly comprising:

a mounting block having a seam-receiving groove formed in a bottom surface thereof, said seam-receiving groove being defined partially by an internal upper surface of said mounting block;

first and second coupling means extending through opposed first and second side portions of said mounting block, respectively, each coupling means having a terminal end adapted to move toward a central axis of said seam-receiving groove;

a clamping member having first and second sidewalls spaced apart from one another, said clamping member being freely positioned within said seam-receiving groove such that said first and second sidewalls are positioned between the central axis of said seam-receiving groove and said first and second coupling means, respectively, each of said sidewalls having a first side opposing said terminal end of a respective one of said coupling means and a second side adapted to oppose a metal roof seam, each of said sidewalls comprising a plastically deformable metal material and having a thickness that is sufficiently small such that, upon engagement of said terminal end of a respective one of said coupling means on said first side of said sidewall, a protrusion is formed on said second side of said sidewall at a location opposed to said terminal end of said respective one of said coupling means.

17. The snow guard assembly of claim 16, wherein said clamping member further comprises a top wall connecting said first and second sidewalls to one another.

18. The snow guard assembly of claim 17, wherein said clamping member is configured in the shape of an inverted U.

19. The snow guard assembly of claim 17, further comprising a corrosion-resistant, non-metallic coating on said second side of each sidewall of said clamping member.

20. The snow guard assembly of claim 19, wherein said corrosion-resistant, non-metallic coating also covers an internal surface of said top wall of said clamping member.

21. The snow guard assembly of claim 16, wherein said seam-receiving groove extends along the entire length of said mounting block and said clamping member extends along the entire length of said seam-receiving groove.

22. The snow guard assembly of claim 16, comprising two of said clamping members spaced apart from one another along the length of said mounting block.

23. The snow guard assembly of claim 22, wherein said first and second coupling means engage a first one of said clamping members, and said mounting assembly further comprises third and fourth coupling means extending through said opposed first and second side portions of said mounting block, respectively, and each of said third and fourth coupling means has a terminal end that engages the other one of said clamping members.

24. The snow guard assembly of claim 16, wherein said first and second coupling means are axially offset from one another along the length of said mounting block.

25. The snow guard assembly of claim 23, wherein said third and fourth coupling means are axially offset from one another along the length of said mounting block.

26. The snow guard assembly of claim 16, wherein said plastically deformable metal material is selected from the group consisting of stainless steel, anodized aluminum, aluminum alloys, copper and copper alloys.

27. A mounting assembly for securing a structure to a metal roof seam, said mounting assembly comprising:

a mounting block having a seam-receiving groove formed in a bottom surface thereof;

at least one coupling means extending through a first side portion of said mounting block and having a terminal end adapted to move toward a central axis of said seam-receiving groove; and at least one clamping member interposed between the central axis of said seam-receiving groove and said coupling means, said clamping member having a first side opposing said terminal end of said coupling means and a second side adapted to oppose a metal roof seam, said clamping member comprising a plastically deformable metal material and having a thickness that is sufficiently small such that, upon engagement of said terminal end of said coupling means on said first side of said clamping member, a protrusion is formed on said second side of said clamping member at a location opposed to said terminal end of said coupling means.

28. A mounting assembly for securing a structure to a metal roof seam, said mounting assembly comprising:

a mounting block having a seam-receiving groove formed in a bottom surface thereof, said seam-receiving groove being defined partially by an internal upper surface of said mounting block;

first and second coupling means extending through opposed first and second side portions of said mounting block, respectively, each coupling means having a terminal end adapted to move toward a central axis of said seam-receiving groove;

first and second clamping members formed integrally with said mounting block and extending downwardly from said internal upper surface, said first and second clamping members being interposed between the central axis of said seam-receiving groove and said first and second coupling means, respectively, each clamping member having a first side opposing said terminal end of a respective one of said coupling means and a second side adapted to oppose a metal roof seam, each of said clamping members comprising a plastically deformable metal material and having a thickness that is sufficiently small such that, upon engagement of said terminal end of a respective one of said coupling means on said first side of said clamping member, a protrusion is formed on said second side of said clamping member at a location opposed to said terminal end of said respective one of said coupling means.

29. A mounting assembly for securing a structure to a metal roof seam, said mounting assembly comprising:

a mounting block having a seam-receiving groove formed in a bottom surface thereof, said seam-receiving groove being defined partially by an internal upper surface of said mounting block;

first and second coupling means extending through opposed first and second side portions of said mounting block, respectively, each coupling means having a terminal end adapted to move toward a central axis of said seam-receiving groove;

a clamping member having first and second sidewalls spaced apart from one another, said clamping member being freely positioned within said seam-receiving groove such that said first and second sidewalls are positioned between the central axis of said seam-receiving groove and said first and second coupling means, respectively, each of said sidewalls having a first side opposing said terminal end of a respective one of said coupling means and a second side adapted to oppose a metal roof seam, each of said sidewalls comprising a plastically deformable metal material and having a thickness that is sufficiently small such that, upon engagement of said terminal end of a respective one of said coupling means on said first side of said sidewall, a protrusion is formed on said second side of said sidewall at a location opposed to said terminal end of said respective one of said coupling means.

30. A snow guard assembly adapted to be attached to a metal roof seam by a mounting assembly, said mounting assembly comprising:

a mounting block having a seam-receiving groove formed in a bottom surface thereof, wherein said seam-receiving groove is defined partially by an internal upper surface of said mounting block;

at least one coupling means extending through a first side portion of said mounting block and having a terminal end adapted to move toward a central axis of said seam-receiving groove; and at least one clamping member formed integrally with said mounting block and extending downwardly from said internal upper surface, said clamping member being interposed between the central axis of said seam-receiving groove and said coupling means, said clamping member comprising a plastically deformable metal material, and having a first side opposing said terminal end of said coupling means and a second side adapted to oppose a metal roof seam.

31. The snow guard assembly of claim 30, wherein said terminal end of said coupling means further comprises a concave portion.

32. The snow guard assembly of claim 31, wherein said seam-receiving groove is further defined by a first side proximate said first side portion of said mounting block, and a corresponding second side opposing said first side such that said seam-receiving groove and said clamping member are interposed between said first and second sides, said second side further comprising a protruding portion positioned in substantial alignment with said concave terminal end of said coupling means.

* * * * *